US010100559B2

(12) United States Patent
Machida et al.

(10) Patent No.: US 10,100,559 B2
(45) Date of Patent: Oct. 16, 2018

(54) VEHICLE DOOR LOCK DEVICE

(71) Applicant: AISIN SEIKI KABUSHIKI KAISHA, Kariya-shi, Aichi-ken (JP)

(72) Inventors: Toshio Machida, Toyota (JP); Shinsuke Takayanagi, Okazaki (JP); Yasuhiro Nagaya, Nishio (JP)

(73) Assignee: AISIN SEIKI KABUSHIKI KAISHA, Kariya-Shi, Aichi-Ken (JP)

( * ) Notice: Subject to any disclaimer, the term of this patent is extended or adjusted under 35 U.S.C. 154(b) by 35 days.

(21) Appl. No.: 15/342,724

(22) Filed: Nov. 3, 2016

(65) Prior Publication Data

US 2017/0130492 A1 May 11, 2017

(30) Foreign Application Priority Data

Nov. 6, 2015 (JP) ..... 2015-218958

(51) Int. Cl.

| | |
|---|---|
| ***E05B 81/20*** | (2014.01) |
| ***E05B 81/36*** | (2014.01) |
| ***E05B 79/20*** | (2014.01) |
| ***E05B 81/06*** | (2014.01) |
| ***E05B 81/66*** | (2014.01) |
| ***E05B 83/40*** | (2014.01) |

(52) U.S. Cl.

CPC ..... *E05B 81/20* (2013.01); *E05B 79/20* (2013.01); *E05B 81/06* (2013.01); *E05B 81/36* (2013.01); *E05B 81/66* (2013.01); *E05B 83/40* (2013.01)

(58) Field of Classification Search

CPC ..... Y10T 292/1082; Y10T 292/1047; Y10S 292/23; E05Y 2900/531; E05B 81/20; E05B 81/6614; E05B 81/06; E05B 81/68

See application file for complete search history.

(56) References Cited

U.S. PATENT DOCUMENTS 4,762,348 A * 8/1988 Matsumoto ..... E05B 81/06 292/201
5,713,613 A * 2/1998 Honma ..... E05B 77/48 292/201
6,719,356 B2 * 4/2004 Cleland ..... E05F 1/1091 296/146.8

(Continued)

FOREIGN PATENT DOCUMENTS

JP 2009-155938 A 7/2009

*Primary Examiner* — Justin B Rephann

(74) *Attorney, Agent, or Firm* — Buchanan Ingersoll & Rooney PC

(57) ABSTRACT

A vehicle door lock device includes: an actuating lever linked to an electric motor, rotatable in a rotation regulating range, rotating in one direction toward a closing position on one end side of the rotation regulating range, thereby holding, in a complete-closing state, a door having been in a half-closed state, and rotating in the other direction toward a release position on the other end side, thereby releasing the holding of the door in the complete-closing state; a first neutrality detecting switch generating a first neutrality detection signal having logic switched at a first neutral position; and a second neutrality detecting switch generating a second neutrality detection signal having logics switched at a second neutral position and a release start position which are a boundary position of the neutral region on the closing position side, and a boundary position of the neutral region on the release position side, respectively.

4 Claims, 7 Drawing Sheets

(56) References Cited

U.S. PATENT DOCUMENTS 6,848,727 B1 * 2/2005 Cetnar ..... E05B 81/20 292/201
6,964,438 B2 * 11/2005 Koike ..... E05B 81/20 292/201
6,974,165 B2 * 12/2005 Koike ..... E05B 81/14 292/201
8,474,887 B2 7/2013 Suzuki et al.
8,870,246 B2 * 10/2014 Itami ..... E05B 81/20 292/201
2003/0067175 A1 * 4/2003 Shiota ..... E05B 81/20 292/201
2004/0227356 A1 * 11/2004 Koike ..... E05B 81/14 292/216
2009/0165386 A1 * 7/2009 Suzuki ..... E05B 81/20 49/282
2010/0064588 A1 * 3/2010 Jitsuishi ..... E05B 81/20 49/358
2010/0270815 A1 * 10/2010 Shinoda ..... E05B 81/20 292/201
2011/0016794 A1 * 1/2011 Nishikibe ..... E05B 81/14 49/359
2011/0167730 A1 * 7/2011 Itami ..... E05B 81/20 49/279
2011/0181051 A1 * 7/2011 Itami ..... E05B 81/20 292/2
2014/0000169 A1 * 1/2014 Yokomori ..... B60J 5/00 49/349
2016/0062365 A1 * 3/2016 Yamashita ..... E05B 1/00 318/468
2016/0201361 A1 * 7/2016 Hanaki ..... E05B 81/16 292/200
2017/0268265 A1 * 9/2017 Hiramoto ..... E05B 81/74

* cited by examiner

VEHICLE DOOR LOCK DEVICE

CROSS REFERENCE TO RELATED APPLICATIONS

This application is based on and claims priority under 35 U.S.C. § 119 to Japanese Patent Application 2015-218958, filed on Nov. 6, 2015, the entire contents of which are incorporated herein by reference.

TECHNICAL FIELD

This disclosure relates to a vehicle door lock device.

BACKGROUND DISCUSSION

In the related art, as a vehicle door lock device, a device disclosed in JP 2009-155938A (FIG. 6) (Reference 1) is known. The device is configured to include a latch (latch mechanism) that can hold a vehicle door in a complete-closing state, and a sector gear (actuating lever) that is mechanically linked to the latch and is driven to rotate by an electric motor. The sector gear is actuated to rotate in one direction from a predetermined neutral region toward a closing region in a preset rotation regulating range, and thereby the latch is actuated to hold, in the complete-closing state, the door having been in a half-closed state. Otherwise, the sector gear is actuated to rotate in another direction (reverse direction) from the neutral region to a release region, and thereby the latch is actuated to release the holding of the door in the complete-closing state. After the sector gear is actuated to rotate from the neutral region toward any region, the sector gear rotates to return to the neutral region.

In addition, the device includes a rotary type of first neutrality detecting switch and second neutrality detecting switch. FIG. 9 is a view illustrating a simplified relationship between a rotating position of a sector gear within a rotation regulating range and logic (H or L level) of a detection signal that is output from the first neutrality detecting switch and the second neutrality detecting switch, corresponding to the rotating position. In the same figure, the first neutrality detecting switch generates a first neutrality detection signal having logic that is switched at a first neutral position which is a boundary position between the neutral region and the closing region, and the second neutrality detecting switch generates a second neutrality detection signal having logic that is switched at a second neutral position which is a boundary position between the neutral region and a release region. In other words, the first neutrality detecting switch generates the first neutrality detection signal that has the H level in the closing region, and has the L level in the neutral region and the release region. The second neutrality detecting switch generates the second neutrality detection signal that has the H level in the release region, and has the L level in the neutral region and the closing region. Hence, both of the first and second neutrality detection signals have the L level, and thereby detecting that the sector gear is in the neutral region.

Normally, when the sector gear is actuated to rotate from the closing region to the neutral region, drive (energization) of the electric motor is stopped, based on the switching of the logic of the first neutrality detection signal. At this time, a time lag from the stop of the energization of the electric motor to an actual stop of the rotation of the electric motor occurs, and thereby the sector gear is stopped at a position in the neutral region, which is closer to the release region than the first neutral position. Otherwise, when the sector gear is actuated to rotate from the release region to the neutral region, the drive (energization) of the electric motor is stopped, based on the switching of the logic of the second neutrality detection signal. At this time, the time lag from the stop of the energization of the electric motor to the actual stop of the rotation of the electric motor occurs, and thereby the sector gear is stopped at a position in the neutral region, which is closer to the closing region than the second neutral position.

On the other hand, when the sector gear is actuated to rotate from the closing region to the neutral region, drive (energization) of the electric motor is also stopped, based on the switching of the logic of the second neutrality detection signal, in a case where the logic of the first neutrality detection signal is not switched due to any reason (for example, a mechanical failure). In this manner, even when the logic of the first neutrality detection signal is not switched, the sector gear reaches the second neutral position and thereby the rotation of the sector gear is rapidly stopped (a so-called fail-safe function).

Incidentally, a rotating amount A1 of the sector gear corresponding to the neutral region is set, depending on a rotating amount of the sector gear from the stopping of the energization of the electric motor to the actual stop of the rotation of the electric motor. This is because the sector gear, which returns from the closing region, enters the neutral region even when the time lag described above has an effect on the sector gear. Hence, during actuation of the fail-safe function, even in a case where the energization of the electric motor is stopped, based on the switching of the logic of the second neutrality detecting switch, there is a need to secure a rotating amount A2 equal to the rotating amount A1 and to set a virtual neutral region. With the rotating amount A2 in the virtual neutral region, holding of the door in the complete-closing state needs not to be released even in the release region. In other words, a rotating amount of the sector gear corresponding to the release region, is a total amount (=A2+B) of the rotating amount A2 by which the sector gear is allowed to idle and a rotating amount B obtained when the holding of the door in the complete-closing state is actually released. A rotating amount of the sector gear corresponding to the neutral region and the release region is a total rotating amount (=A1+A2+B) of the regions, and it is inevitable that a rotating amount of the sector gear required to the release of the holding of the door in the complete-closing state increases, that is, that a period of time taken to the release is prolonged.

SUMMARY

Thus, a need exists for a vehicle door lock device which is not suspectable to the drawback mentioned above.

A vehicle door lock device according to an aspect of this disclosure includes: an actuating lever that is linked to an electric motor, is provided to be rotatable in a rotation regulating range, rotates in one direction from a neutral region toward a closing position on one end side of the rotation regulating range, thereby holding, in a complete-closing state, a door having been in a half-closed state, and rotates in the other direction from the neutral region toward a release position on the other end side of the rotation regulating range, thereby releasing the holding of the door in the complete-closing state; a first neutrality detecting switch that generates a first neutrality detection signal having logic that is switched at a first neutral position in the neutral region; and a second neutrality detecting switch that generates a second neutrality detection signal having logic that is switched at a second neutral position which is a boundary position of the neutral region on the closing position side, and having logic that is switched at a release start position which is a boundary position of the neutral region on the release position side.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Hereinafter, an embodiment of a vehicle door lock device will be described. Note that, hereinafter, a frontward-rearward direction of a vehicle is referred to as a "frontward-rearward direction", and upward and downward in a height direction of a vehicle is referred to as "upward" and "rearward".

Figure 1:
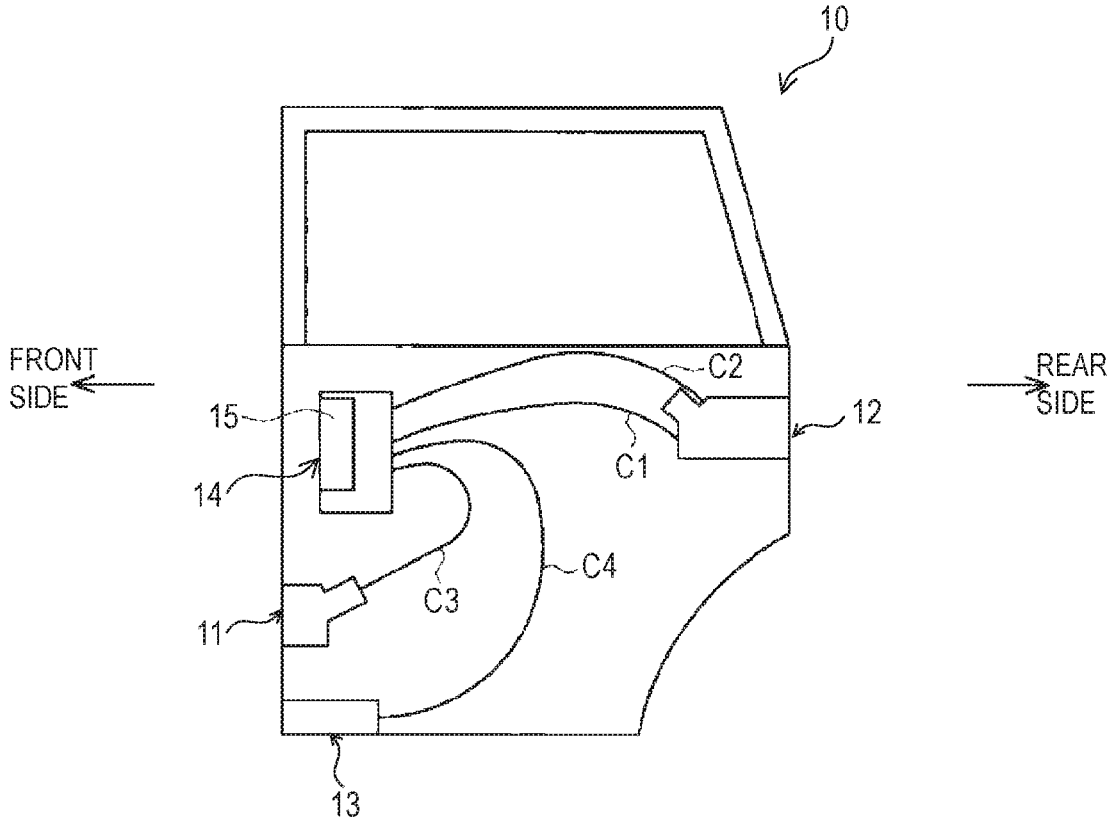
FIG. 1 is a conceptual diagram of a sliding door to which an embodiment of a vehicle door lock device is applied.

As illustrated in FIG. 1, a sliding door 10 as a door, which is supported in a side section of a body of a vehicle via an appropriate support member (not illustrated), opens and closes an opening that is formed in the body according to movement in the frontward-rearward direction and is used for entering and exiting the vehicle. The sliding door 10 is provided inside with a complete-closing door lock device 11 that engages with the body side, thereby holding the sliding door 10 in a complete-closing state, and a closing-releasing device 12 that holds the sliding door 10 in the complete-closing state or in a half-closed state (closing state), and further a full-opening door lock device 13 that engages with the body side, thereby holding the sliding door 10 in a full-opening state.

The closing-releasing device 12 performs electrical closing actuation on the sliding door 10 in the half-closed state to the complete-closing state. In addition, the closing-releasing device 12 is mechanically linked to a proper remote control 14 (remote control device) disposed in the sliding door 10 via a release cable C1, and is mechanically linked to the remote control 14 via an opening cable C2. The closing-releasing device 12 releases the holding of the sliding door 10 in the complete-closing state through transmission of an electric release operating force via the release cable C1, the remote control 14, and the opening cable C2.

Note that the remote control 14 is connected to an operation handle 15 that is exposed on an exterior surface or an interior surface of the sliding door 10, thus, similarly, the closing-releasing device 12 releases the holding of the sliding door 10 in the complete-closing state through transmission of a manual release operating force of the operation handle 15 via the opening cable C2.

In addition, the remote control 14 is mechanically linked to the complete-closing door lock device 11 and the full-opening door lock device 13 via the opening cables C3 and C4, respectively, and thus the electric release operating force of the closing-releasing device 12 or the manual release operating force of the operation handle 15 is transmitted to the complete-closing door lock device 11 and the full-opening door lock device 13. At this time, the complete-closing door lock device 11 releases the holding of the sliding door 10 in the complete-closing state, or the full-opening door lock device 13 releases the holding of the sliding door 10 in the full-opening state.

Figure 2:
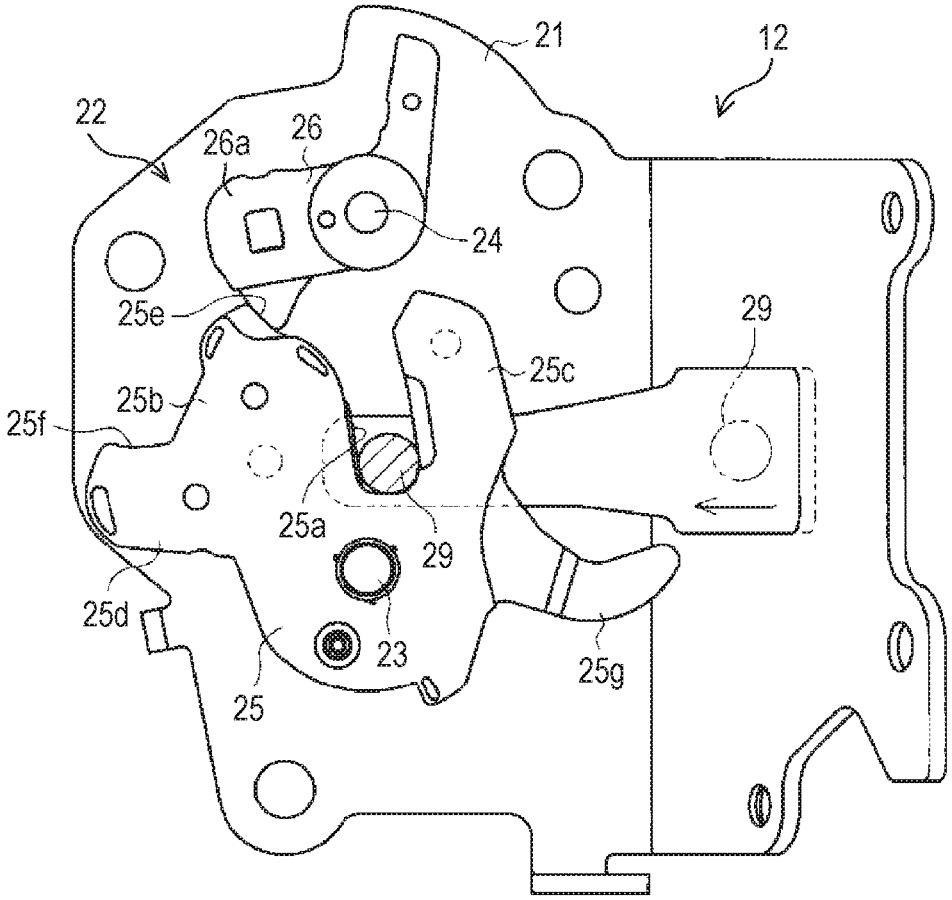
FIG. 2 is a front view illustrating a latch mechanism.

As illustrated in FIG. 2, the closing-releasing device 12 includes a base plate 21 that is formed of a metal plate, for example, and is widely fastened over a rear end surface of the sliding door 10, and includes a latch mechanism 22 disposed in the base plate 21. The latch mechanism 22 includes a latch 25 and a pole 26 linked to a pair of rotary shafts 23 and 24, which are rotatably supported in the base plate 21 and are parallel to each other, so as to integrally rotate, respectively.

A recessed engagement portion 25*a* having a substantial U shape is formed in the latch 25. The latch 25 has a first hook portion 25*b* and a second hook portion 25*c* formed on one side and the other side (sides in a counterclockwise rotating direction and in a clockwise rotating direction in FIG. 2), respectively, with the recessed engagement portion 25*a* interposed therebetween. In addition, the latch 25 has a third hook portion 25*d* formed to project from a middle portion of the first hook portion 25*b* in a longitudinal direction thereof. An end surface of a front end portion of the first hook portion 25*b* which faces the second hook portion 25*c*, and an end surface of the third hook portion 25*d* which faces the first hook portion 25*b*, in a circumferential direction, form a full-latched engagement surface 25*e* and a half-latched engagement surface 25*f*, respectively. A latch biasing spring (not illustrated) that has one end hooking on the base plate 21 and has the other end hooking on the latch 25, thereby the latch is biased to a side to which the latch rotates in the clockwise rotating direction in the figure, and the rotation of the latch in the direction is regulated with the latch coming into contact with a latch stopper (not illustrated) disposed in the base plate 21. At this time, the latch is held at a predetermined initial rotating position (hereinafter, referred to as an "unlatched position"). Note that the latch 25 has an arm-shaped interlocking piece 25*g* projecting to a side opposite to the third hook portion 25*d* with the rotary shaft 23 interposed therebetween.

The pole 26 has a substantially hook-shaped engagement end portion 26*a* formed to extend from the rotary shaft 24 to one side in a radial direction (left side in FIG. 2). The pole 26 is biased to a side to which a pole biasing spring (not illustrate) causes the pole to rotate in the counterclockwise rotating direction in the figure, that is, a side to which the engagement end portion 26*a* is caused to move to a lower side in the figure, and the pole is held at a predetermined initial rotating position.

Here, a basic operation of the latch mechanism 22 is described.

In a state in which the sliding door 10 is opened, the latch 25 held at the unlatched position allows the recessed engagement portion 25*a* to face a striker 29 fixed to the body. In other words, the recessed engagement portion 25*a* opens an approach route of the striker 29 in response to the closing actuation of the sliding door 10. In addition, in a state in which the pole 26 is held at the predetermined initial rotating position, the engagement end portion 26*a* is disposed above the third hook portion 25*d*. Note that the state of the latch mechanism 22 at this time is referred to as an unlatched state (release state).

Next, the striker 29 approaches the inside of the recessed engagement portion 25*a* in response to the closing actuation of the sliding door 10. At this time, an inner wall surface of the recessed engagement portion 25*a* is pressed by the striker 29, thereby the latch 25 rotates in the counterclockwise rotating direction in the figure against the latch biasing spring, and is stopped from rotating, with the engagement end portion 26*a* hooking on the half-latched engagement surface 25*f*. At this time, the sliding door 10 is in the half-closed state in which the striker 29 engages with the recessed engagement portion 25*a* so as to be locked. A state of the latch mechanism 22 at this time is referred to as a half-latched state, and a rotating position of the latch 25 is referred to as a half-latched position.

Subsequently, the striker 29 further approaches the inside of the recessed engagement portion 25*a* in response to the further closing actuation of the sliding door 10. At this time, the inner wall surface of the recessed engagement portion 25*a* is pressed by the striker 29, thereby the latch 25 more rotates in the counterclockwise rotating direction in the figure against the latch biasing spring, and is stopped from rotating, with the engagement end portion 26*a* hooking on the full-latched engagement surface 25*e*, as illustrated in FIG. 2. At this time, the sliding door 10 is in the complete-closing state in which the striker 29 engages with the recessed engagement portion 25*a* so as to be locked. A state of the latch mechanism 22 at this time is referred to as a full-latched state (engagement state), and a rotating position of the latch 25 is referred to as a full-latched position.

In addition, in the half-latched state or in the full-latched state, when the pole 26 rotates in the clockwise rotating direction in the figure against the pole biasing spring, the hooking of engagement end portion 26*a* on the half-latched engagement surface 25*f* or the full-latched engagement surface 25*e* is released. At this time, when the sliding door 10 starts opening actuation due to a repulsive force of a seal member or the like, the striker 29, which exits from the inside of the recessed engagement portion 25*a*, presses the inner wall surface of the recessed engagement portion 25*a*, and thereby the latch 25 rotates in the clockwise rotating direction in the figure. Thus, the engagement of the recessed engagement portion 25*a* with the striker 29 is released, and thus the sliding door 10 is able to be opened.

Figure 3:
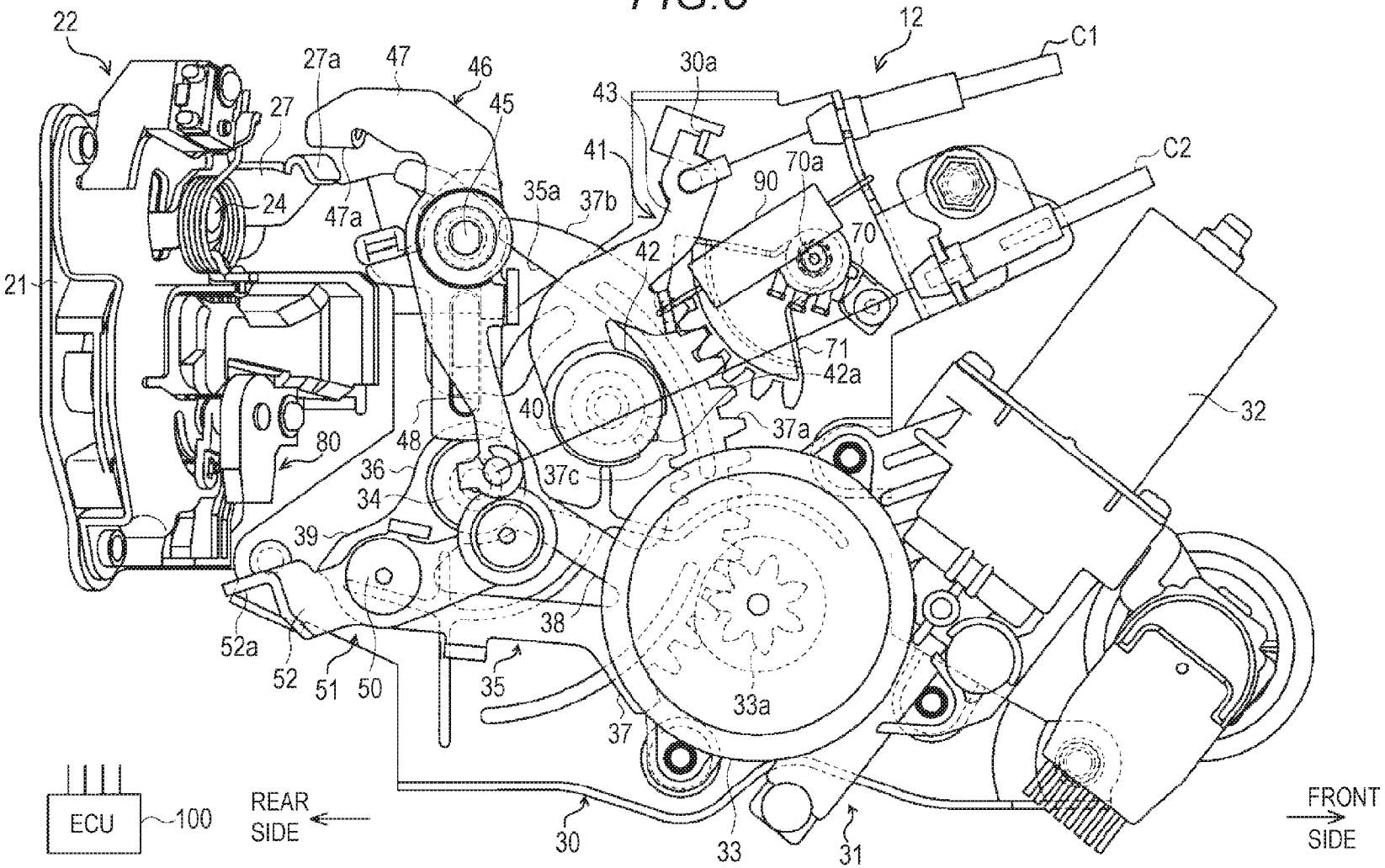
FIG. 3 is a side view illustrating a structure of the vehicle door lock device of the embodiment.

Note that, as illustrated in FIG. 3, the closing-releasing device 12 includes a latching switch 80 that is configured of a rotary switch, for example. The latching switch 80 detects the rotating position (unlatched position or the like) of the latch 25. In addition, the closing-releasing device 12 includes a pole driving lever 27 that is linked to the rotary shaft 24 so as to be integrally rotated. A front end portion of the pole driving lever 27 is curved upward so as to be convex such that a pressing target portion 27*a* is formed. Note that a rotating direction of the pole driving lever 27, in which the pressing target portion 27*a* moves downward, is coincident with a rotating direction of the pole 26 that is released from the engagement state with the latch 25 described above.

A base plate 30, which is widened toward the front side of the vehicle and, for example, is formed of a metal plate, is fastened to the base plate 21. The base plate 30 is fastened to the sliding door 10 separately from the base plate 21. An actuator 31 is disposed in a lower front portion of the base plate 30 and an electronic control unit (ECU) 100 controls drive of the actuator. The actuator 31 includes an electric motor 32 and a deceleration mechanism 33 that decelerates the rotation of a rotary shaft of the electric motor 32. Note that a pinion 33*a* is fixed to an output shaft of the deceleration mechanism 33.

In addition, a first support pin 34 having a substantially circular cylinder shape is fixed to the base plate 30 so as to have a centerline extending substantially in parallel with an axial core of the pinion 33*a* on an obliquely upper-rear side of the pinion 33*a* and, for example, an active lever 35 as an actuating lever formed of a metal plate is rotatably supported by the first support pin 34. In other words, the active lever 35 includes a substantially circular support portion 36 through which the first support pin 34 penetrates and is rotatably supported. In addition, the active lever 35 includes a linkage portion 37 having a substantially circular arc shape, which is disposed outside the support portion 36 in a radial direction with the first support pin 34 as the center, and includes a connection portion 38 that connects, in the radial direction with the first support pin 34 as the center, the support portion 36 and an end portion of the linkage portion 37 on one side (side in the clockwise rotating direction in the figure) in a circumferential direction with the first support pin 34 as the center. Thus, in the active lever 35, a substantially fan-shaped groove 35*a* is formed of an outer circumferential portion of the support portion 36, an inner circumferential portion of the linkage portion 37, and a side wall of the connection portion 38. The groove opens on the other side (side in the counterclockwise rotating direction in the figure) in the circumferential direction with the first support pin 34 as the center.

Figure 4:
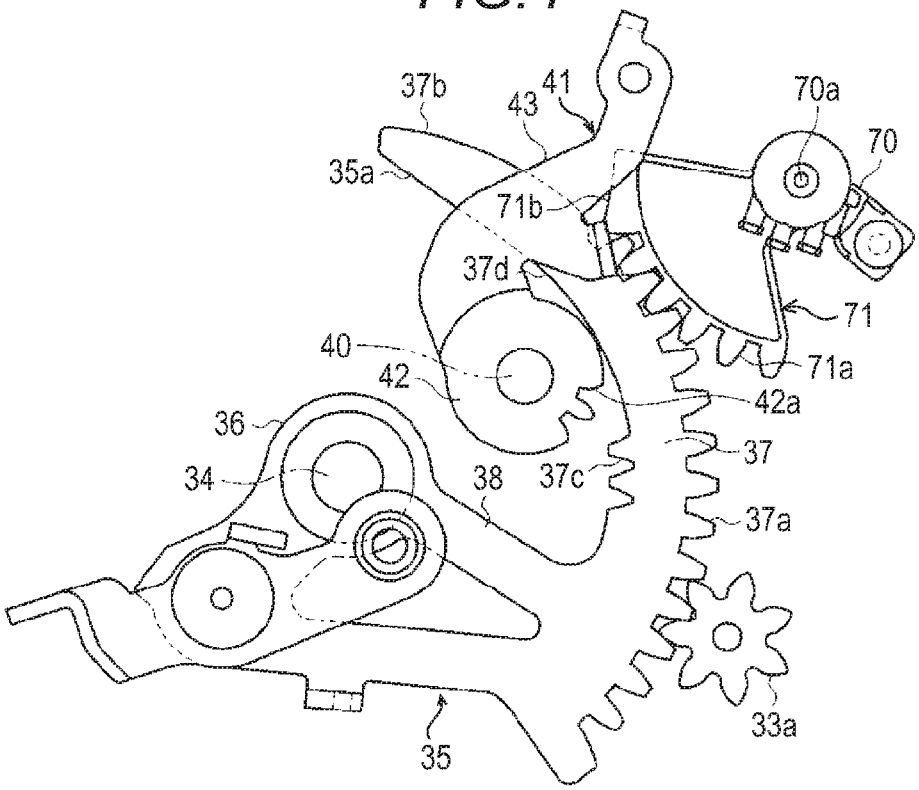
FIG. 4 is a side view illustrating a state of an active lever in a neutral region.

As also illustrated in FIG. 4, the active lever 35 includes a first gear portion 37*a* and a first cam portion 37*b* side by side on the outer circumferential portion of the linkage portion 37 in the circumferential direction with the first support pin 34 as the center. The first gear portion 37*a* is formed of a plurality of external teeth and meshes with the pinion 33*a* of the actuator 31. Hence, when the pinion 33*a* rotates, the active lever 35 rotates around the first support pin 34 in a direction corresponding to a rotating direction of the pinion 33*a*. In addition, a rotation regulating range of the active lever 35 is set in advance and rotation of the active lever is regulated in a case where a terminal end of the first gear portion 37*a* reaches the pinion 33*a* or the like. A "neutral region" means an intermediate section of the rotation regulating range including a rotating position of the active lever 35 illustrated in FIG. 4, in which the first gear portion 37*a* meshes with the pinion 33*a* in an intermediate section of the first gear portion in the circumferential direction.

The first cam portion 37*b* is molded to have an arcuate surface shape extending in the circumferential direction with the first support pin 34 as the center and the diameter thereof is set to equal to a mean length of both diameters of the addendum circle and the dedendum circle of the first gear portion 37*a*.

Note that an internal gear portion 37*c* formed of a plurality of internal teeth is formed on the inner circumferential portion of the linkage portion 37, which is closer to the connection portion 38. In addition, a release portion 37*d* is formed on the inner circumferential portion of the linkage portion 37. The release portion basically has an inner diameter equal to the diameter of the dedendum circle of the internal gear portion 37*c* (internal teeth), and extends from the internal gear portion 37*c* to the other side in the circumferential direction (side in the counterclockwise rotating direction in the figure) with the first support pin 34 as the center. Further, as illustrated in FIG. 3, the active lever 35 has an extension piece 39 that extends from the support portion 36 obliquely downward and rearward in a radial direction with the first support pin 34 as the center. A front end portion of the extension piece 39, which is separated from the first support pin 34, rotates toward the front side and is connected to the linkage portion 37 in the vicinity of the connection portion 38.

A second support pin 40 having a substantially stepped circular cylinder shape is fixed to the base plate 30 so as to have a centerline extending substantially in parallel with a centerline of the first support pin 34 in the groove 35*a* of the active lever 35, and, for example, a release lever 41 formed of a metal plate is rotatably supported by the second support pin 40. In other words, the release lever 41 includes a substantially circular lever support portion 42 through which the second support pin 40 penetrates and is rotatably supported. A gear portion 42*a*, which is formed of a plurality of external teeth, is formed on an outer circumferential portion of the lever support portion 42 at a position at an angle on an obliquely lower-front side in FIG. 3, and the gear portion 42*a* of the lever support portion can mesh with the internal gear portion 37*c* of the active lever 35.

In addition, the release lever 41 has a substantially bow-shaped projection piece 43 that extends from the lever support portion 42 obliquely upward and rearward in the radial direction with the second support pin 40 as the center.

A bias member 90, which is formed of a coil spring, for example, has one end hooking on the base plate 30 and the other end hooking on the release lever, thereby the release lever 41 is biased to a side to which rotation thereof is performed in the clockwise rotating direction in the figure, and the rotation in the direction is regulated with the release lever coming into contact with a stopper piece 30*a* formed on the base plate 30. At this time, the release lever 41 is held at a predetermined initial rotating position.

Figure 5:
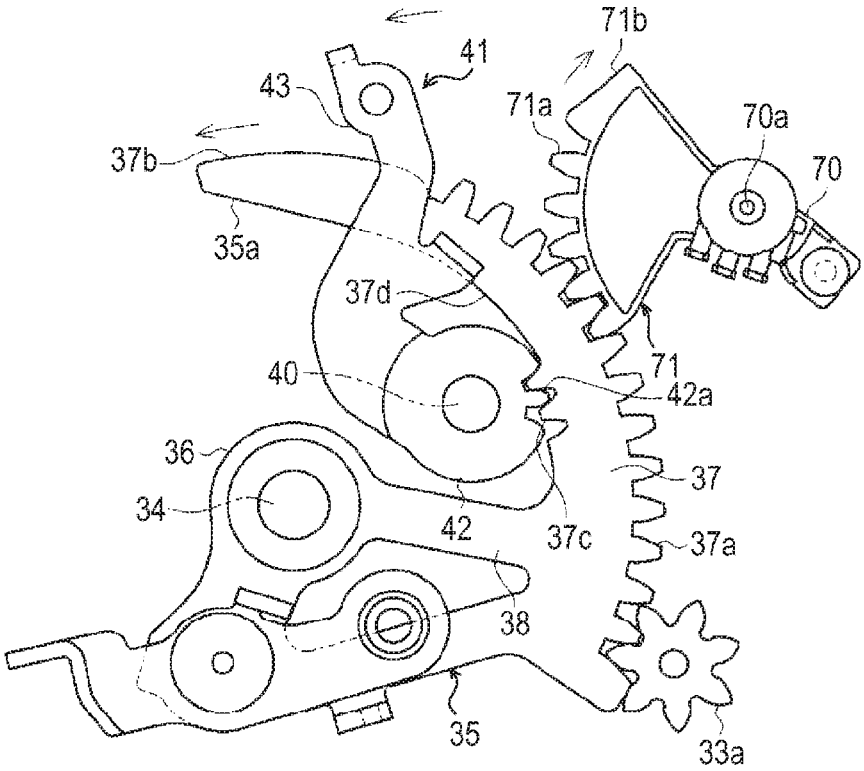
FIG. 5 is a side view illustrating a state of the active lever at a release position.

As also illustrated in FIG. 4, when the release lever 41 is disposed at the initial rotating position, the gear portion 42*a* is disposed on the release lever 41 ahead in the counterclockwise rotating direction in the figure, of the internal gear portion 37*c* of the active lever 35 positioned in the neutral region. Thus, as illustrated in a change to FIG. 5, when the active lever 35 rotates in the counterclockwise rotating direction in the figure, the internal gear portion 37*c* meshes with the gear portion 42*a* through a predetermined idle traveling zone. In this manner, the release lever 41 starts rotating in the counterclockwise rotating direction in the figure against a bias force of the bias member 90, in response to the rotation of the active lever 35 in the counterclockwise rotating direction in the figure. Note that, although the lever support portion 42 basically has an outer diameter equal to the diameter of the addendum circle of the gear portion 42*a* (external teeth), the release portion 37*d* is formed in the linkage portion 37, and thereby there is no occurrence of interference.

As illustrated in FIG. 3, in the configuration, a terminal of the release cable C1 is bound to a front end of the release lever 41 (the lever projection piece 43) such that rotation of the release lever 41 from the initial rotating position causes the release cable C1 to be tensioned to the closing-releasing device 12 side. In other words, the electric release operating force of the closing-releasing device 12 is generated by the rotation of the release lever 41 from the initial rotating position.

A support pin 45 having a substantially circular cylinder shape is fixed to the base plate 30 so as to have a centerline extending above the first support pin 34 substantially in parallel with the centerline of the first support pin 34, and, for example, an opening lever 46 formed of a metal plate is rotatably supported by the support pin 45. The opening lever 46 has a substantially bow-shaped first lever projection piece 47 that extends upward in a radial direction with the support pin 45 as the center, and has an arm-shaped second lever projection piece 48 that extends downward in the radial direction with the support pin 45 as the center. Thus, a front end portion of the first lever projection piece 47 is curved downward so as to be convex above the pressing target portion 27*a* of the pole driving lever 27 such that a pressing portion 47*a* is formed.

In the opening lever 46, a terminal of the opening cable C2 is bound to a front end of the second lever projection piece 48. Hence, when the opening cable C2 is tensioned to the remote control 14 side, the opening lever 46 rotates in the counterclockwise rotating direction in the figure with the support pin 45 as the center. At this time, the pressing portion 47*a* of the opening lever 46 presses the pressing target portion 27*a* of the pole driving lever 27 downward, and thereby the pole driving lever 27 rotates such that the pressing target portion 27*a* moves downward. In this manner, the pole 26 that integrally rotates with the pole driving lever 27 is released from the engagement state with the latch 25. In other words, the electric release operating force of the closing-releasing device 12 or the manual release operating force of the operation handle 15 is transmitted to the closing-releasing device 12 in a state in which the opening cable C2 is tensioned to the remote control 14 side and the opening lever 46 rotates. A "release position Pr" means the rotating position of the active lever 35 illustrated in FIG. 5, in which the engagement state of the pole 26 with the latch 25 is completely released.

A support pin 50 having a substantially circular cylinder shape is fixed to a front end portion of the extension piece 39 of the active lever 35 so as to have a centerline extending substantially in parallel with the centerline of the first support pin 34, and, for example, a closing lever 51 formed of a metal plate is rotatably supported by the support pin 50. The closing lever 51 has a lever projection piece 52 extending rearward in the radial direction with the support pin 50 as the center. A front end of the lever projection piece 52 forms a substantially L-shaped push-up wall 52*a* that stands on the front side orthogonal to a surface of paper. The closing lever 51 is held by using an appropriate holding member so as to substantially rotate integrally along with the active lever 35, and thus the push-up wall 52*a* is disposed below the interlocking piece 25*g* of the latch 25 disposed at the half-latched position when the active lever 35 is in the neutral region. Hence, when the active lever 35 and the closing lever 51 rotate in the clockwise rotating direction in the figure, the latch 25, of which the interlocking piece 25*g* is pressed by the push-up wall 52*a*, rotates from the half-latched position to the full-latched position. At this time, as described above, the sliding door 10 in the half-closed state enters the complete-closing state. A "closing position Pc" means a rotating position of the active lever 35 illustrated in FIG. 6 at which the sliding door 10 is completely held in the complete-closing state by the latch mechanism 22.

As illustrated in FIG. 3, a neutral switch 70, for example, as a first neutrality detecting switch and a second neutrality detecting switch configured of a rotary switch, is installed on the base plate 30 above the pinion 33*a*. The neutral switch 70 includes a circuit board and an internal moveable piece that switches between electrical connection states with the circuit board, and an axis of an operation shaft 70*a*, which integrally rotates along with the moveable piece, extends substantially in parallel with an axis of the pinion 33*a*. Thus, a substantially fan-shaped neutral switch lever 71 made of a resin material is connected to the operation shaft 70*a* so as to integrally rotate.

As also illustrated in FIG. 4, the neutral switch lever 71 includes a second gear portion 71*a* and a second cam portion 71*b* side by side on the outer circumferential surface of the neutral switch lever in the circumferential direction with the operation shaft 70*a* as the center. In other words, the neutral switch lever 71 has a so-called tooth-chipped gear shape. The second gear portion 71*a* is formed of a plurality of external teeth and meshes with the first gear portion 37*a* of the active lever 35. Hence, when the first gear portion 37*a* and the second gear portion 71*a* are in a meshed state, the active lever 35 rotates, and thereby the neutral switch lever 71 rotates around the operation shaft 70*a* in a direction corresponding to the rotating direction of the active lever. The neutral switch 70 having the operation shaft 70*a*, which rotates along with the neutral switch lever 71 in response to the rotation of the active lever 35, detects that the active lever 35 is in the neutral region.

Figure 6:
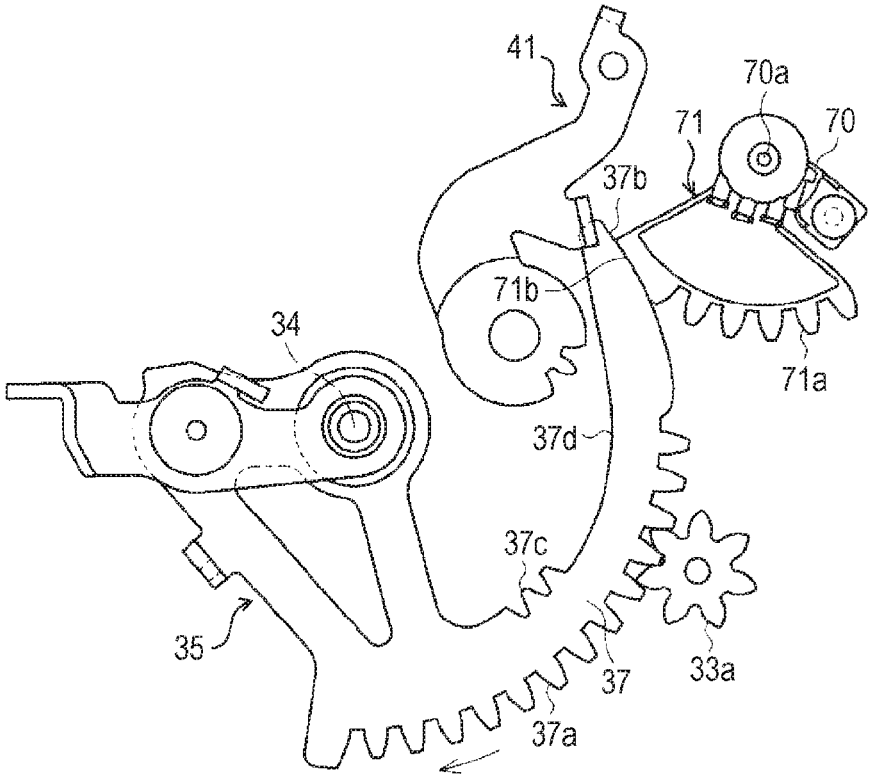
FIG. 6 is a side view illustrating a state of the active lever at a closing position.

The second cam portion 71*b* is molded to have an arcuate surface shape and can come into contact with the first cam portion 37*b* of the active lever 35. As also illustrated in FIG. 6, when the second cam portion 71*b* is in a contact state in which the entire range of the second cam portion in the circumferential direction is in contact with the first cam portion 37*b*, the second cam portion extends in the circumferential direction with the first support pin 34 as the center. Hence, the first cam portion 37*b* projects to the inner side of the second cam portion 71*b* in the radial direction with the operation shaft 70*a* as the center, and thereby the rotation of the neutral switch lever 71 is regulated. On the other hand, the first cam portion 37*b* is caused to slide on the second cam portion 71*b*, and thereby the active lever 35 can rotate with respect to the neutral switch lever 71.

Next, a relationship between a rotating position of the active lever 35 within a rotation regulating range and logic (H or L level) of a detection signal that is output from the neutral switch 70, corresponding to the rotating position is described along with a state of the latch mechanism 22. Note that the neutral switch 70 is configured to output two types of detection signals (hereinafter, referred to as a "first neutrality detection signal N1" and a "second neutrality detection signal N2") individually corresponding to the rotating position of the active lever 35.

Figure 7:
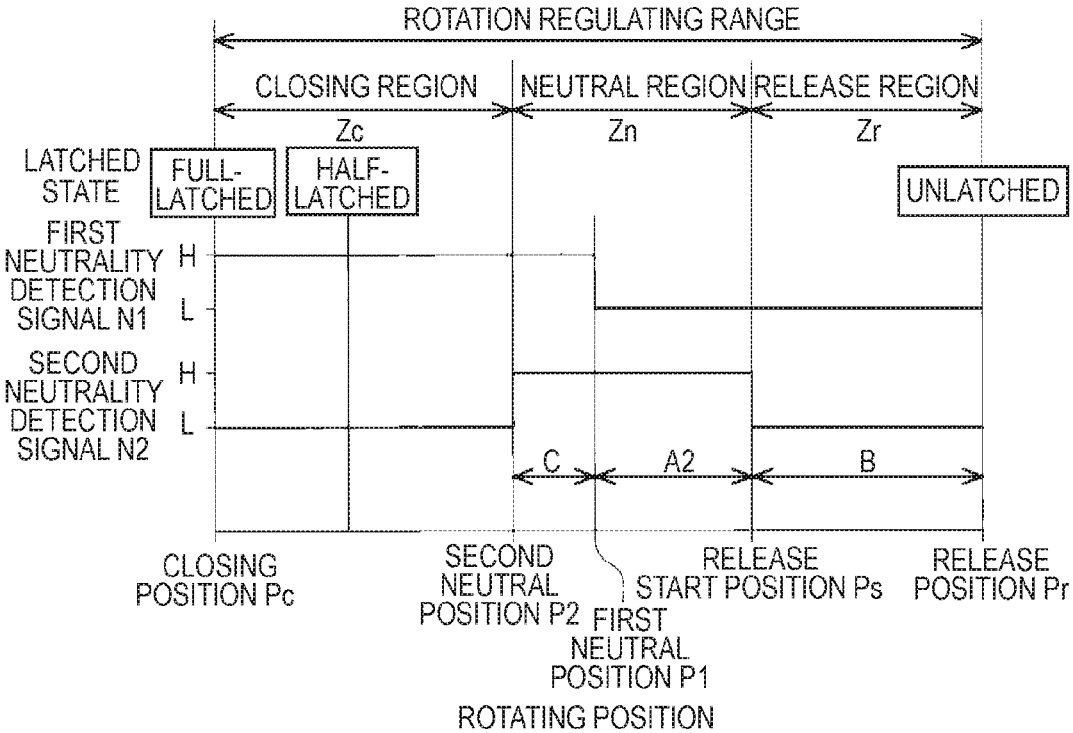
FIG. 7 is a view illustrating a relationship between a rotating position of the active lever within a rotation regulating range and logic (H or L level) of a first neutrality detection signal and a second neutrality detection signal which correspond to the rotating position.

As illustrated in FIG. 7, the rotation regulating range of the active lever 35 is between the closing position Pc and the release position Pr. Thus, a neutral region Zn is disposed in an intermediate section of the rotation regulating range which is interposed between the closing position Pc and the release position Pr. Note that a "closing region Zc" means a rotating range of the active lever 35 between a boundary position (hereinafter, referred to as a "second neutral position P2") of the neutral region Zn, which is closer to the closing position Pc, and the closing position Pc. When the active lever 35 rotates in the closing region Zc to the closing position Pc, the latch mechanism 22 switches from the half-latched state to the full-latched state.

In addition, a "release region Zr" means a rotating range of the active lever 35 between a boundary position (hereinafter, referred to as a "release start position Ps") of the neutral region Zn, which is closer to the release position Pr, and the release position Pr. When the active lever 35 rotates in the release region Zr to the release position Pr, the latch mechanism 22 switches to the unlatched state.

Here, the first neutrality detection signal N1 has logic that is switched to have an H level and an L level on the closing position Pc side and the release position Pr side, respectively, with a predetermined first neutral position P1 which is an intermediate position of the neutral region Zn as a boundary. On the other hand, the second neutrality detection signal N2 has logic that is switched to H level in the neutral region Zn and to the L level in both of the closing region Zc and the release region Zr.

Note that, as described above, when the active lever 35 rotates in the closing region Zc toward the closing position Pc, the first cam portion 37*b* slides on the second cam portion 71*b*, and thereby the rotation of the neutral switch lever 71 is regulated along with the rotation of the neutral switch 70. However, even when the rotation of the neutral switch 70 is regulated (stopped), the logic of the first and second neutrality detection signal N1 and N2 is maintained until the active lever 35 reaches the closing position Pc, and then, for example, there is no influence on the detection of the position of the active lever 35 in the neutral region Zn.

Thus, since a rotating amount A2 (first rotating amount) of the active lever 35 corresponding to a region between the first neutral position P1 and the release start position Ps is set, depending on a rotating amount of the active lever 35 from stopping of energization of the electric motor 32 to actual stopping of the rotation of the electric motor 32. In addition, a rotating amount B of the active lever 35 corresponding to the release region Zr is set, depending on a rotating amount obtained when the latch mechanism 22 switches to the unlatched state (the holding of the sliding door 10 in the complete-closing state is actually released). More specifically, the rotating amount B is set to a range from a rotating position of the active lever 35 detected when the internal gear portion 37*c* starts meshing with the gear portion 42*a* to a rotating position of the active lever 35 detected when the pole 26 that integrally rotate along with the pole driving lever 27 linked to the release lever 41 is released from the engagement state with the latch 25. Further, A rotating amount C (second rotating amount) of the active lever 35 corresponding to a region between the second neutral position P2 and the first neutral position P1 is set to a rotating amount (C<<A2) which is very small to the extent that timings of switching the signals of the first neutrality detection signal N1 and the second neutrality detection signal N2 are not reversed due to variations in manufacturing the neutral switch 70, compared to the rotating amount A2 or the like.

Next, an example of a process executed by the ECU 100 when the latch mechanism 22 switches to the full-latched state will be schematically described. The process starts when the latching switch 80 detects that the latch 25 is disposed at the half-latched position (that is, the half-closed state of the sliding door 10).

Figure 8:
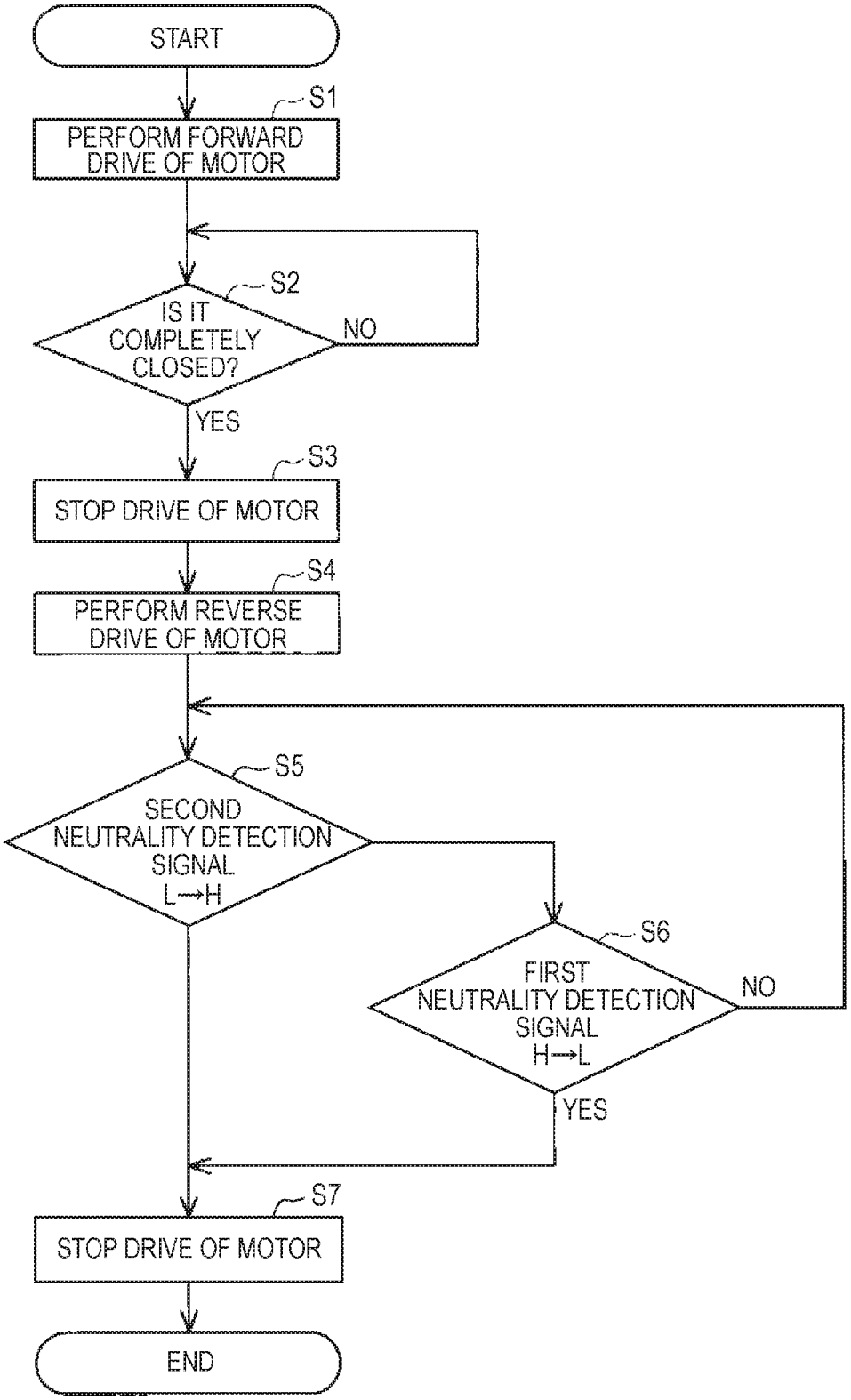
FIG. 8 is a flowchart illustrating a control process of the vehicle door lock device of the embodiment.
Figure 9:
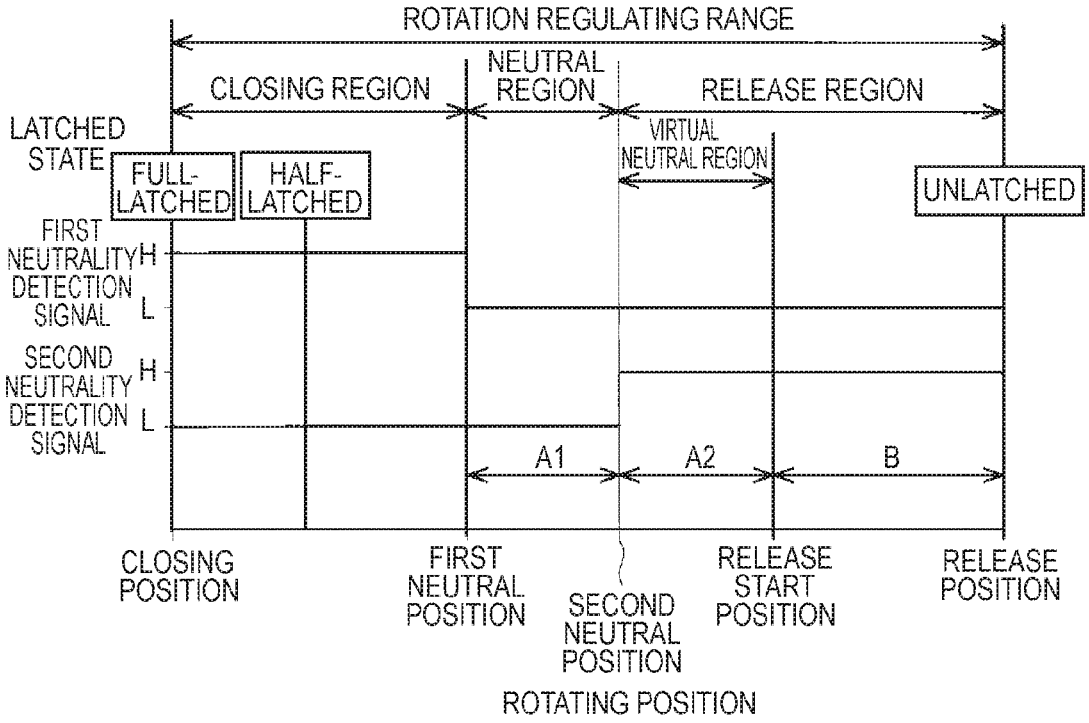
FIG. 9 is a view illustrating a simplified relationship between a rotating position of a sector gear within a rotation regulating range and logic (H or L level) of a first neutrality detection signal and a second neutrality detection signal which correspond to the rotating position according to an example in the related art.

As illustrated in FIG. 8, when the process is executed through a routine, the ECU 100 energizes the electric motor 32 such that the electric motor rotates forward (Step S1). At this time, the active lever 35 rotates toward the closing position Pc. Subsequently, the ECU 100 determines whether or not the sliding door 10 is in the complete-closing state, based on whether or not the latching switch 80 detects that the latch 25 is disposed at the full-latched position (Step S2). Thus, the ECU 100 continues the forward driving of the electric motor 32 when it is not determined that the sliding door 10 is in the complete-closing state, and stops drive of the electric motor 32 when it is determined that the sliding door 10 is in the complete-closing state (Step S3). At this time, the active lever 35 reaches the closing position Pc.

Then, the ECU 100 energizes the electric motor 32 and the electric motor rotates reversely (Step S4). At this time, the active lever 35 rotates toward the neutral region Zn. Subsequently, the ECU 100 determines whether or not the logic of the second neutrality detection signal N2 switches from the L level to the H level, that is, whether or not the active lever 35 reaches the second neutral position P2 (Step S5). Then, when it is determined that the logic of the second neutrality detection signal N2 does not switch from the L level to the H level, the ECU 100 determines whether or not the logic of the first neutrality detection signal N1 switches from the H level to the L level, that is, whether or not the active lever 35 reaches the first neutral position P1 (Step S6). Then, when it is determined that the logic of the first neutrality detection signal N1 does not switch from the H level to the L level, the ECU 100 returns to Step S5 and repeats the same process.

On the other hand, when it is determined that the logic of the second neutrality detection signal N2 switches from the L level to the H level in Step S5, or it is determined that the logic of the first neutrality detection signal N1 switches from the H level to the L level in Step S6, the ECU 100 stops the drive of the electric motor 32 (Step S7) and the process ends. In other words, the ECU 100 continues the reverse driving of the electric motor 32 until it is determined that the logic of the second neutrality detection signal N2 switches from the L level to the H level, or it is determined that the logic of the first neutrality detection signal N1 switches from the H level to the L level. Note that, since the second neutral position P2 is positioned to be closer to the closing position Pc than the first neutral position P1, normally, it is determined that the logic of the second neutrality detection signal N2 switches from the L level to the H level, that is, the active lever 35 reaches the second neutral position P2, and thereby the reverse driving of the electric motor 32 is stopped.

Next, the effects of the embodiments will be described.

Normally, when the active lever 35 is actuated to rotate from the closing position Pc to the neutral region Zn, the drive (energization) of the electric motor 32 is stopped, based on the switching of the logic of the second neutrality detection signal N2 at the second neutral position P2. In this case, when there is a time lag from the stop of the energization of the electric motor 32 to the actual stop of the rotation of the electric motor 32, and thus a rotating amount of the active lever 35 obtained at this time is smaller than the rotating amount of the active lever 35 corresponding to the neutral region Zn, the active lever 35 enters the neutral region Zn.

On the other hand, when the active lever 35 is actuated to rotate from the closing position Pc to the neutral region Zn, the logic of the second neutrality detection signal N2 at the second neutral position P2 does not switch due to any reason (for example, a mechanical failure). In this case, the drive (energization) of the electric motor 32 is stopped (fail-safe function), based on the switching of the logic of the first neutrality detection signal N1 at the first neutral position P1. Also in this case, when there is a time lag from the stop of the energization of the electric motor 32 to the actual stop of the rotation of the electric motor 32, and thus a rotating amount of the active lever 35 obtained at this time is equal to or smaller than the rotating amount of the active lever 35 corresponding to a region between the first neutral position P1 and the release start position Ps, the active lever 35 enters the neutral region Zn.

As described above, the rotating amount of the active lever 35 corresponding to the region between the release start position Ps and the release position Pr may be the rotating amount B obtained when the holding of the door in the complete-closing state of the sliding door 10 is actually released. Then, the rotating amount C of the active lever 35 corresponding to the region between the second neutral position P2 and the first neutral position P1 may be very small (substantially zero) to the extent that it is possible to check the switching of the logic. Hence, the rotating amount of the active lever 35 obtained by adding up the neutral region Zn until the release of the holding of the sliding door 10 in the complete-closing state becomes a total rotating amount thereof (=A2+B+C). Therefore, it is possible to decrease the rotating amount of the active lever 35 required until the release of the holding the sliding door 10 in the complete-closing state, and further it is possible to more shorten a period of time taken to the release.

As described above in detail, according to the embodiment, the following effects are to be achieved.

(1) In the embodiment, the rotating amount of the active lever 35 obtained by adding up the neutral region Zn until the release of the holding of the sliding door 10 in the complete-closing state becomes a total rotating amount thereof (=A2+B+C). Therefore, it is possible to decrease the rotating amount of the active lever 35 required until the release of the holding the sliding door 10 in the complete-closing state, and further it is possible to more shorten a period of time taken to the release. Thus, it is possible to improve a sense of operation.

Note that the embodiment described above may be modified as follows.

In the embodiment described above, a neutral switch lever (71), which is linked to the active lever 35 to continue rotating until the active lever reaches the closing position Pc, may be employed.

In the embodiment described above, a neutral switch lever (71), which is connected to the active lever 35 via a link mechanism or a cam mechanism, and thereby is linked to the active lever to continue rotating, may be employed.

In this case, a neutral switch lever, which is linked to the active lever 35 to continue rotating until the active lever reaches the closing position Pc may be employed, or a neutral switch lever, which is stopped at a position within the closing region Zc, may be employed. Otherwise, a neutral switch lever, which changes gears depending on a rotating position of the active lever 35, may be employed.

In the embodiment described above, the neutral switch lever 71 may be omitted, and a neutral switch (70), which directly detects a rotating position of the active lever 35 may be employed.

In the embodiment described above, as long as the first neutrality detection signal N1 has logic that switches at the first neutral position P1, the logic (H and L levels) may be reversed. Similarly, as long as the second neutrality detection signal N2 has logic that switches at the second neutral position P2, and switches at the release start position Ps, the logic (H and L levels) may be reversed.

In the embodiment described above, one neutral switch 70, which generates the first neutrality detection signal N1 and the second neutrality detection signal N2, individually, is employed. In this respect, a first neutrality detecting switch and a second neutrality detecting switch separately provided from each other, which generate the first neutrality detection signal (N1) and the second neutrality detection signal (N2), respectively, may be employed. In this case, the first neutrality detecting switch and the second neutrality detecting switch may be configured of rotary switches, respectively, or may be configured of an on-off switch in which a contact position is opened or closed by directly pushing by the neutral switch lever (71) or the active lever (35), depending on the rotating position thereof.

In the embodiment described, a state occurring when the latch mechanism 22 switches to the full-latched state is described; however, this disclosure is not limited thereto, and this disclosure can be applied to a state occurring when the latch mechanism 22 switches to the unlatched state. Specifically, when the active lever 35 is actuated to rotate from the release position Pr to the neutral region Zn, the drive (energization) of the electric motor 32 is stopped, based on the switching of the logic of the first neutrality detection signal N1 in the first neutral position P1, in a case where the logic of the second neutrality detection signal N2 is not switched due to any reason (for example, a mechanical failure). After the stop of the electric motor 32, the active lever 35 stops in the neutral region Zn, or the closing region Zc by passing through the neutral region Zn. Then, the electric motor 32 rotates reversely and the drive (energization) of the electric motor 32 is stopped, based on the switching of the logic of the first neutrality detection signal N1. After the stop of the electric motor 32, the active lever 35 stops at the same position as that during actuation of the fail-safe function when the active lever 35 rotates from the closing position Pc to the neutral region Zn.

This disclosure may be applied to a swing type door, for example, or may be applied to a back door that is disposed in the rear section of a vehicle.

A vehicle door lock device according to an aspect of this disclosure includes: an actuating lever that is linked to an electric motor, is provided to be rotatable in a rotation regulating range, rotates in one direction from a neutral region toward a closing position on one end side of the rotation regulating range, thereby holding, in a complete-closing state, a door having been in a half-closed state, and rotates in the other direction from the neutral region toward a release position on the other end side of the rotation regulating range, thereby releasing the holding of the door in the complete-closing state; a first neutrality detecting switch that generates a first neutrality detection signal having logic that is switched at a first neutral position in the neutral region; and a second neutrality detecting switch that generates a second neutrality detection signal having logic that is switched at a second neutral position which is a boundary position of the neutral region on the closing position side, and having logic that is switched at a release start position which is a boundary position of the neutral region on the release position side.

According to this configuration, normally, when the actuating lever is actuated to rotate from the closing position to the neutral region, drive (energization) of the electric motor is stopped, based on the switching of the logic of the second neutrality detection signal at the second neutral position. In this case, when there is a time lag from the stop of the energization of the electric motor to an actual stop of rotation of the electric motor, and a rotating amount of the actuating lever obtained at this time is smaller than a rotating amount of the actuating lever corresponding to the neutral region, the actuating lever enters the neutral region.

On the other hand, in a case where the logic of the second neutrality detection signal at the second neutral position is not switched due to any reason when the actuating lever is actuated to rotate from the closing position to the neutral region, drive (energization) of the electric motor is stopped, based on the switching of the logic of the first neutrality detection signal at the first neutral position. Also in this case, when there is a time lag from the stop of the energization of the electric motor to the actual stop of rotation of the electric motor, and a rotating amount of the actuating lever obtained at this time is equal to or smaller than the rotating amount of the actuating lever corresponding to a region between the first neutral region and the release start position, the actuating lever enters the neutral region.

As described above, the rotating amount of the actuating lever corresponding to the region between the release start position and the release position may be a rotating amount obtained when the holding of the door in the complete-closing state is actually released. Thus, the rotating amount of the actuating lever corresponding to the region between the second neutral position and the first neutral position may be small. Hence, the rotating amount of the actuating lever obtained by adding up the neutral region until the release of the holding of the door in the complete-closing state becomes a total rotating amount thereof. Therefore, it is possible to decrease the rotating amount of the actuating lever required until the release of the holding the door in the complete-closing state, and further it is possible to more shorten a period of time taken to the release.

It is preferable that the vehicle door lock device further includes: a control device that controls drive of the electric motor, in which, when the electric motor is driven to cause the actuating lever to rotate from the closing position to the neutral region, the control device stops the drive of the electric motor, based on switching of the logic of the second neutrality detection signal at the second neutral position, or stops the drive of the electric motor, based on switching of the logic of the first neutrality detection signal at the first neutral position, when the logic of the second neutrality detection signal is not switched.

In the vehicle door lock device, it is preferable that a first rotating amount of the actuating lever between the first neutral position and the second neutral position is smaller than a second rotating amount of the actuating lever between the first neutral position and the release start position.

In the vehicle door lock device, it is preferable that the first neutrality detecting switch and the second neutrality detecting switch configure a single switch.

This disclosure has an effect that it is possible to more shorten a period of time taken to a release of holding of a door in a complete-closing state.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A vehicle door lock device comprising:

an actuating lever that is linked to an electric motor, is provided to be rotatable in a rotation regulating range, rotates in one direction from a neutral region toward a closing position on one end side of the rotation regulating range, thereby holding, in a complete-closing state, a door having been in a half-closed state, and rotates in an other direction from the neutral region toward a release position on an other end side of the rotation regulating range, thereby releasing the holding of the door in the complete-closing state;

a first neutrality detecting switch that generates a first neutrality detection signal having a level that is switched when the actuating lever reaches a first neutral position in the neutral region; and a second neutrality detecting switch that generates a second neutrality detection signal having a level that is switched when the actuating lever reaches a second neutral position which is a boundary position of the neutral region on the closing position side, and that is switched when the actuating lever reaches a release start position which is a boundary position of the neutral region on the release position side.

2. The vehicle door lock device according to claim 1, further comprising:

a control device that controls drive of the electric motor, wherein, when the electric motor is driven to cause the actuating lever to rotate from the closing position to the neutral region, the control device stops the drive of the electric motor, based on switching of the level of the second neutrality detection signal when the actuating lever reaches the second neutral position, or, when the level of the second neutrality detection signal is not switched, based on switching of the level of the first neutrality detection signal when the actuating lever reaches the first neutral position.

3. The vehicle door lock device according to claim 1, wherein a first rotating amount of the actuating lever between the first neutral position and the second neutral position is smaller than a second rotating amount of the actuating lever between the first neutral position and the release start position.

4. The vehicle door lock device according to claim 1, wherein the first neutrality detecting switch and the second neutrality detecting switch configure a single switch.

* * * * *